US008973500B2

(12) United States Patent
Elter et al.

(10) Patent No.: US 8,973,500 B2
(45) Date of Patent: Mar. 10, 2015

(54) METHOD FOR CONTROLLING THE AMOUNT OF DAMPENING SOLUTION IN A PRINTING UNIT OF A PRINTING PRESS

(75) Inventors: Peter Elter, Mühlhausen (DE); Nikolaus Pfeiffer, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 190 days.

(21) Appl. No.: 13/549,672

(22) Filed: Jul. 16, 2012

(65) Prior Publication Data

US 2013/0014659 A1 Jan. 17, 2013

(30) Foreign Application Priority Data

Jul. 15, 2011 (DE) ..... 10 2011 107 528

(51) Int. Cl.

| | |
|---|---|
| ***B41F 23/02*** | (2006.01) |
| ***B41L 25/00*** | (2006.01) |
| ***B41F 7/24*** | (2006.01) |
| ***B41F 33/10*** | (2006.01) |

(52) U.S. Cl.

CPC .. *B41F 7/24* (2013.01); *B41F 33/10* (2013.01)
USPC ..... 101/484

(58) Field of Classification Search

USPC ..... 101/484
See application file for complete search history.

(56) References Cited

U.S. PATENT DOCUMENTS

| | | | | |
|---|---|---|---|---|
| 6,668,723 | B2 | 12/2003 | Berton et al. | |
| 6,796,227 | B1 * | 9/2004 | Miller | 101/147 |
| 2011/0132221 | A1 * | 6/2011 | Hartmann et al. | 101/484 |

FOREIGN PATENT DOCUMENTS

| | | | | |
|---|---|---|---|---|
| DE | 100 58 550 | A1 | 5/2002 | |
| DE | 10 2008 061 599 | A1 | 12/2009 | |
| DE | 102008061599 | A1 * | 12/2009 | B41F 33/10 |
| WO | WO 2010020564 | A2 * | 2/2010 | B41F 33/0045 |

OTHER PUBLICATIONS

German Patent and Trademark Office Search Report, Dated Feb. 17, 2012.

* cited by examiner

*Primary Examiner* — Daniel J Colilla
*Assistant Examiner* — Ruben Parco, Jr.
(74) *Attorney, Agent, or Firm* — Laurence A. Greenberg; Werner H. Stemer; Ralph E. Locher

(57) ABSTRACT

A method for controlling an amount of dampening solution in a printing unit of a printing press using a computer and a measuring device, includes setting an amount of dampening solution in the printing unit based on data of a current print job, reducing the amount of dampening solution towards a smearing threshold with the computer, recording color measurement values with the measuring device in at least one full tone area with low area coverage and in at least one halftone area with high area coverage on a printing material of the current print job, and stopping the reduction of the amount of dampening solution with the computer when a dot gain of the halftone in areas with high area coverage increases significantly and a density of the full tone in areas with low area coverage increases significantly.

10 Claims, 3 Drawing Sheets

METHOD FOR CONTROLLING THE AMOUNT OF DAMPENING SOLUTION IN A PRINTING UNIT OF A PRINTING PRESS

CROSS-REFERENCE TO RELATED APPLICATION

This application claims the priority, under 35 U.S.C. §119, of German Patent Application DE 10 2011 107 528.7, filed Jul. 15, 2011; the prior application is herewith incorporated by reference in its entirety.

BACKGROUND OF THE INVENTION

Field of the Invention

The present invention relates to a method for controlling the amount of dampening solution in a printing unit of a printing press using a computer and a measuring device.

In lithographic offset printing presses, dampening solution and printing ink need to be accurately metered to achieve correct coloring. The dampening solution is to be metered in such a way as to ensure that as little dampening solution as possible is used without causing the ink to smear. At present, no functioning sensors are known that accurately detect the amount of dampening solution present in the printing press. A disadvantage of current methods that rely on measuring halftone values in the printed image or in color measurement strips on the printing material or stock through the use of color measuring devices is that the halftone value does not change until the smearing threshold is reached. At that point, smearing can no longer be prevented.

European Patent Application EP 1 477 314 A1, corresponding to U.S. Pat. No. 6,918,339, discloses a method of controlling the dampening solution supply in lithographic offset printing presses. In accordance with that method, color density is determined in specific patterns that have varying area coverage. Area coverages are calculated and are associated with corresponding amounts of dampening solution. In a second computing step, coefficients relating to the emulsification of the ink are calculated for the measured control fields or patches. In a third step, the amount of dampening solution is controlled by taking into account the area coverage and the aforementioned coefficients in the calculation of the amount of dampening solution.

German Patent Application DE 10 2006 029 618 A1, corresponding to U.S. Patent Application Publication No. US 2009/0277353, likewise discloses a method of adjusting the dampening unit in an offset printing press. In accordance with that method, a test form is used. Conclusions may be drawn from the images printed by using the test form as to the optimum amount of dampening solution to be applied and the accurate setting of the dampening unit system in the printing unit of an offset printing press. For that purpose, the test form includes two large-area screen profiles disposed as mirror images of each other and substantially extending across the entire printing plate. The symmetry mirror plane extends perpendicularly to the printing direction, and the screen profiles decrease towards the mirror plane and re-increase from the latter towards the opposite edge. Screen fields of different area coverage are provided. The adjustment of the amount of dampening solution is achieved by a defined modification of the dipping roller speed.

Color measurement devices are known from U.S. Pat. No. 7,884,926 B2, 7,894,065 B2 and U.S. Pat. No. 7,515,267 B2.

In practice, however, the methods mentioned above have not stood the test of time since they do not permit accurate and sensitive dampening solution control due to the slow reaction of the tonal values.

SUMMARY OF THE INVENTION

It is accordingly an object of the invention to provide a method for controlling the amount of dampening solution in a printing unit of a printing press, which overcomes the hereinafore-mentioned disadvantages of the heretofore-known methods of this general type in such a way as to ensure reliable automatic closed-loop control of the amount of dampening solution in the printing unit of a printing press.

With the foregoing and other objects in view there is provided, in accordance with the invention, a method for controlling an amount of dampening solution in a printing unit of a printing press. The method comprises providing a computer and a measuring device, setting the amount of dampening solution in the printing unit based on data of a current print job, reducing the amount of dampening solution towards a smearing threshold with the computer, recording color measurement values with the measuring device in at least one full tone area with low area coverage and in at least one halftone area with high area coverage on printed matter of the current print job, and stopping the reduction of the amount of dampening solution with the computer when a dot gain of the halftone in areas with high area coverage increases significantly and a density of the full tone in areas with low area coverage increases significantly.

In accordance with the method of the invention, printing material produced in the printing press is inspected by using a color measuring device and the measurements are fed to a computer that controls the metering of the amount of dampening solution in the printing unit of the printing press. In a first step, the correct amounts of dampening solution are calculated for each printing unit based on the data of the current print job. The calculation takes into account the characteristic curves of the printing press that are stored in the computer and the properties of the inks and printing material that are used. The original of the current print job also plays an important part in the process, in particular the coloration of the printed image, which may include more or fewer halftones and full tones. In practice, however, the presetting that has been calculated in this way does not correspond with the optimum setting of the amount of dampening solution and thus merely constitutes a starting point because it does not take into account basic conditions such as temperature and humidity. Once the printing press has started up, the computer initially reduces the amount of dampening solution based on the calculated amount of dampening solution or on an increased amount of dampening solution above the calculated amount of dampening solution towards what may be referred to as the smearing threshold. The smearing threshold marks the point at which the amount of dampening solution is so small that the ink begins to smear on the printing material, thus spoiling the product and making it unusable.

During the process of reducing the amount of dampening solution towards the smearing threshold, the color measuring device takes color measurements or records color measurement values in specific predetermined areas on the printing material. The measurement includes at least one full tone area with low area coverage and at least one halftone area with high area coverage in the printed image or in the color measurement strip. The color measurements that are obtained in this way are then evaluated in the computer. The computer stops the reduction of the amount of dampening solution when the dot gain or tonal value gain of the halftone increases significantly in an area of high area coverage and when the density of the full tone increases significantly in an area of low area coverage. This criterion ensures that the amount of dampening solution used in printing is as small as possible but above the smearing threshold. This amount corresponds to the optimum setting for the dampening solution amount during the production run. The area with high area coverage is selected because it requires a large amount of dampening solution, which means that a reduction of the amount of dampening solution quickly causes the halftone dots to run into each other, which is an effect that can be measured on the printing material at an early point. A disadvantage of the area with high area coverage is that full tone densities hardly change and are thus difficult to be accurately measured. For this reason, measurements are also taken in an area of low area coverage that needs a correspondingly small amount of dampening solution. In such an area, the halftone dots only slowly merge, but the full tone density increases quickly. Thus, a corresponding effect of the reduction of the dampening solution can be measured on the printing material at an early point. The combined evaluation of the two areas thus results in the optimum criterion because these are the areas of highest overall sensitivity in which the desired optimum setting for the amount of dampening solution can best be detected.

In accordance with another mode of the invention, color measurement values are recorded or color measurements are taken by the measuring device in at least two halftone areas on the printing material. In this case color measurements are recorded or taken in different halftone ranges such as in a 50% halftone and a 75% halftone. Advantageously, at least one halftone is at a tonal value density of between 70 and 90%. In particular, a 75% halftone has proved to be an advantageous measuring range. These are the areas that exhibit a particularly marked dot gain of the halftone at high area coverage. This means that a particularly sensitive reaction of the control is possible.

In accordance with a further mode of the invention, when a job change occurs, the computer calculates the amount of dampening solution required for the following print job and increases it at the start of the print job to an amount that is slightly above the calculated value. This increase ensures that the method always starts the reduction of the amount of dampening solution on the safe side of the optimum setting for the amount of dampening solution. Since every closed-loop controlling operation has a certain amount of reaction time and a printing press in general represents a sluggish closed-loop control system, the slight increase ensures that the color measuring device records or takes the first measurement values at a setting which has not yet decreased towards the smearing threshold to a value below the optimum setting for the amount of dampening solution.

In accordance with an added mode of the invention, advantageously, the computer may evaluate an original to find suitable color fields for the color measuring operations, determine the suitable color measuring areas in the printed image or color measuring fields in a print control strip, and take the measurements in the determined areas. In this case, the operator of the printing press does not need to select the areas that are suitable for the measuring operations of the color measuring device. Instead, the selection is made automatically by the computer. In the process, the computer analyzes the digital original, which is made available, for example, by the prepress department, with respect to suitable color measuring areas in the printed image and in the color measurement strip. In particular, the computer detects the full tone areas with low area coverage and the halftone areas with high area coverage. The areas that have been detected in this way are then transmitted to the color measuring device, which then takes corresponding color measurements in the areas that have been automatically detected and transmits the measurements to the computer. This is done to ensure that the printing press operator does not select the wrong measuring areas on the printing press by accident, which would result in incorrect dampening solution metering settings.

In accordance with an additional mode of the invention, the computer may reduce the amount of dampening solution step by step, preferably in steps of 3%. During the reduction process, the measuring device takes measurements in the areas. The step-by-step reduction allows the reduction of the amount of dampening solution to take effect in a corresponding way in the color areas on the printing material and thus enables the color measuring device to reliably detect these areas. If the amount of dampening solution was reduced continuously, the dampening solution control could easily become instable because the amount of dampening solution would already have been further reduced when the color measuring device took measurements on the printing material. Especially if the printing material is examined by a color measuring device that is located outside the printing press, the process of attaining stable control of the amount of dampening solution requires a corresponding amount of time in which the amount of dampening solution does not change. If the dampening solution reduction steps are too small, however, the closed-loop dampening solution control process takes too long. If the steps are too large, the controlling process is not sensitive enough and the amount of dampening solution may drop below the optimum amount. It has been found that a preferred step size is a reduction by 3% of the amount of dampening solution.

In accordance with yet another particularly advantageous mode of the invention, the printing material may be measured by a color measuring device provided in the printing press because this allows continuous detection of the corresponding areas at short intervals for evaluation based on the criteria stored in the computer. As a consequence, it is possible for the color measuring device to detect even small changes in the amount of dampening solution that have an effect on the coloration on the printing material and to supply them to the computer for closed-loop dampening solution control purposes. In this way, a particularly quick and accurate closed-loop control is possible because the fulfillment of the criteria stored in the computer for setting the optimum amount of dampening solution above the smearing threshold can be detected with particular accuracy.

In accordance with yet a further mode of the invention, the computer may compare different color measuring fields or patches that require different amounts of dampening solution to carry out a plausibility check. By measuring multiple color measuring fields, for instance in a print control strip, but also in the printed image, it is possible to avoid individual outliers of the color measurements from resulting in too quick or too early fulfillment of the criteria and thus the amount of dampening solution not being properly set.

In accordance with a concomitant mode of the invention, provision is made for a 25% halftone area to be present. This 25% halftone, which may be referred to as lighter tone, represents a further possibility of checking the process of setting the amount of dampening solution. The color measuring device takes color measurements in the 25% halftone. The reduction of the amount of dampening solution is continued only until the color measurements drop. It is only if the color measurements in the 25% halftone do not drop during the reduction of the amount of dampening solution that the assumption can be made that the amount of dampening solution has not yet fallen below the optimum amount. This is an additional way to ensure that the set amount of dampening solution is not below the optimum amount even though the printed image may have a particularly difficult coloration and does not in a suitable way include corresponding areas that are suitable for evaluation in the computer in terms of the fulfillment of the criteria. Thus, even for difficult originals, a reduction of the dampening solution to a value that is too low, i.e. below the optimum value, is prevented.

Other features which are considered as characteristic for the invention are set forth in the appended claims.

Although the invention is illustrated and described herein as embodied in a method for controlling the amount of dampening solution in a printing unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
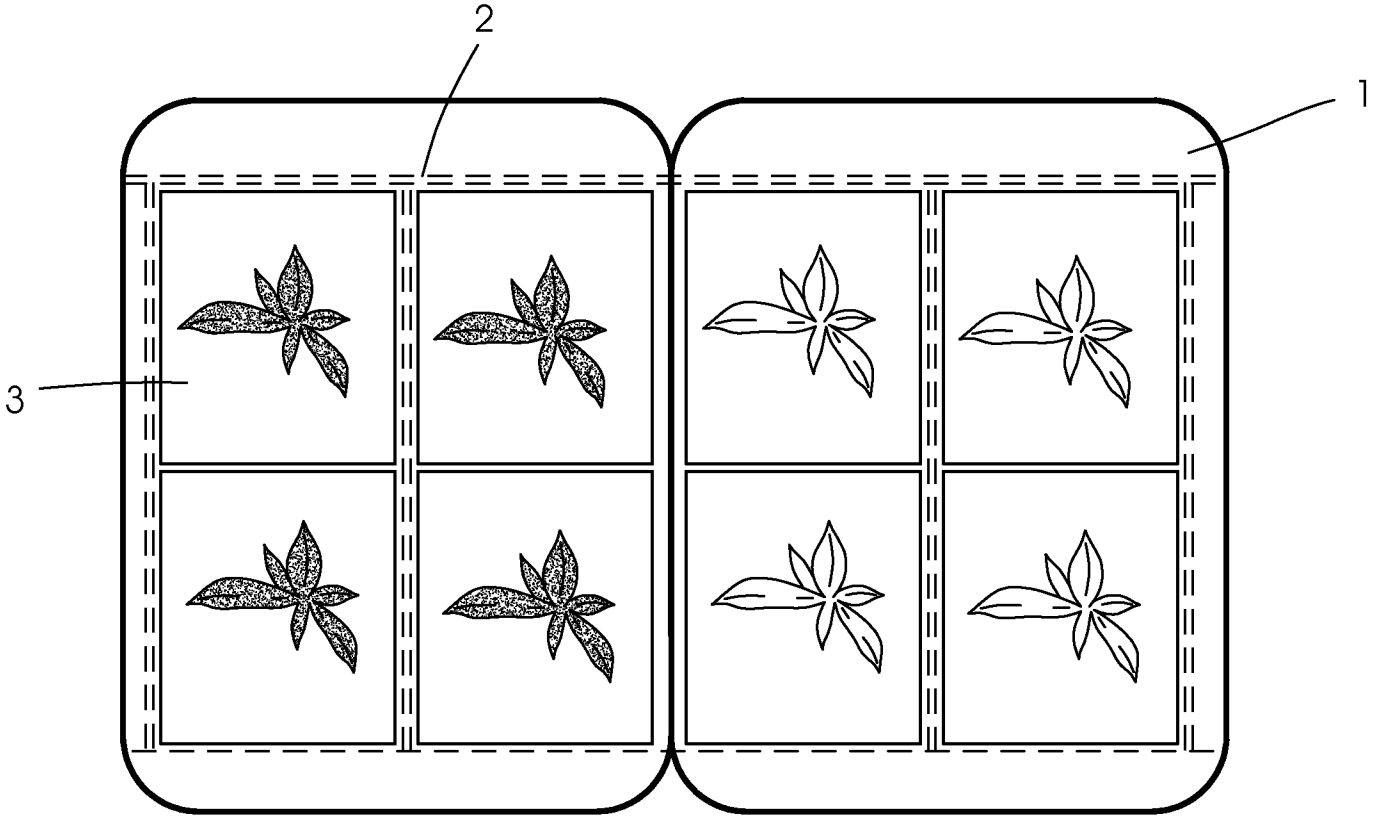
FIG. 1 is a diagrammatic, top-plan view of a printed image on a printing material having an area with high area coverage and an area with low area coverage.

Referring now to the figures of the drawings in detail and first, particularly, to FIG. 1 thereof, there is seen a printed sheet 1 that was printed in a printing unit 11 of a printing press 10 in accordance with an original that includes eight copies on one sheet (8-up sheet). However, individual copies of a printed image 3 have different coloration. The coloration of the four copies on the left-hand side includes areas of high area coverage, whereas the copies on the right-hand side have low area coverage. This is due to the fact that the original of the left-side copies in the printed image 3 has dark images whereas the right-side copies in the printed image contain light images. Print control strips 2 are provided around all of the copies of the printed image 3. These print control strips 2 include color measuring fields that can be detected by a color measuring device 13. In the print control strips 2, different color measuring fields including full tones and halftones are provided.

Figure 2:
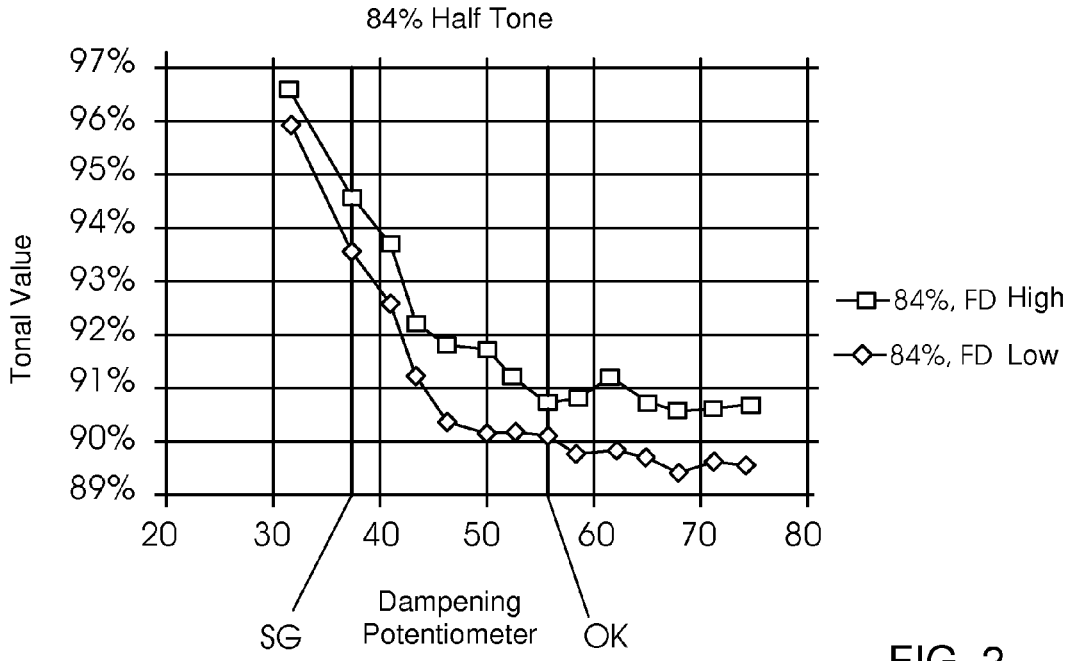
FIG. 2 is a diagram illustrating the effect of a reduction of an amount of dampening solution on a tonal value in the printed image for an 84% halftone.

FIG. 2 illustrates a relationship between the metering of the amount of dampening solution, indicated as "Dampening Potentiometer" and the dot gain indicated as "tonal Value." FIG. 2 illustrates the relationship by way of example for an 84% halftone value. A smearing threshold SG is reached at a dampening solution metering of approximately 38%. During printing, the amount of dampening solution must not drop below that threshold because otherwise smearing would occur. An optimum dampening solution setting OK is at approximately 56% in FIG. 2. The diagram includes two curves, one for the left part of the image of FIG. 1, which has a high area coverage FD, and one for the right part of the image of FIG. 1, which has a low area coverage FD. The optimum dampening solution setting OK is attained when the dot gain of the 84% halftone increases significantly in the area of high area coverage FD. Consequently, the curve of the high area coverage FD is relevant for this criterion, because only this curve relatively quickly exhibits the effects on the 84% halftone in the printed image 3. FIG. 2 shows that the dot gain increases significantly in an 84% halftone with high area coverage FD.

Figure 3:
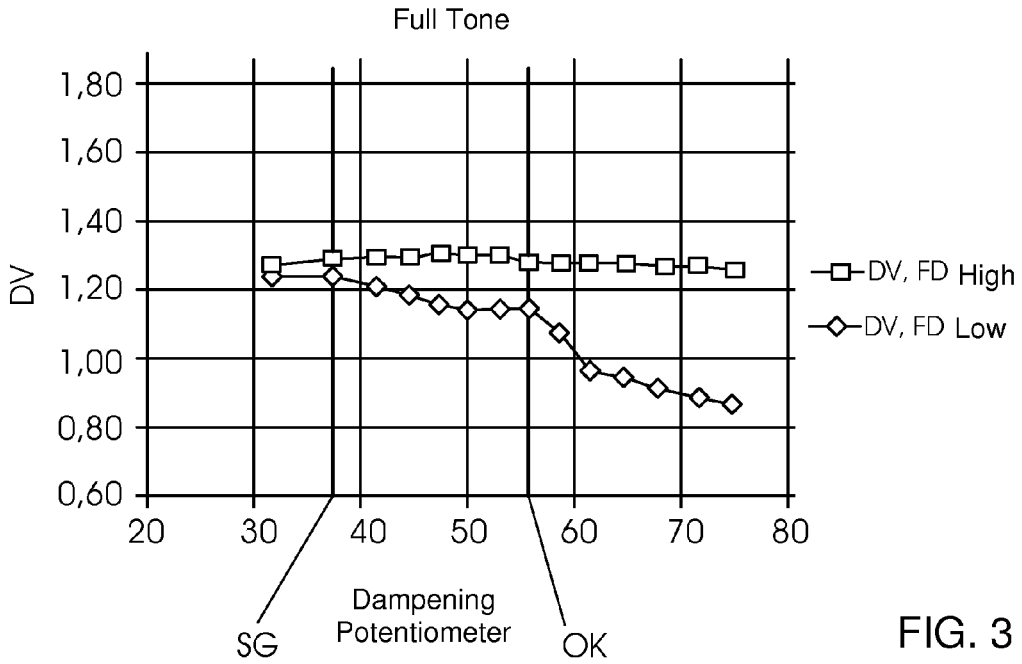
FIG. 3 is a diagram illustrating the effect of a reduction of an amount of dampening solution on the color density in a full tone.
Figure 4:
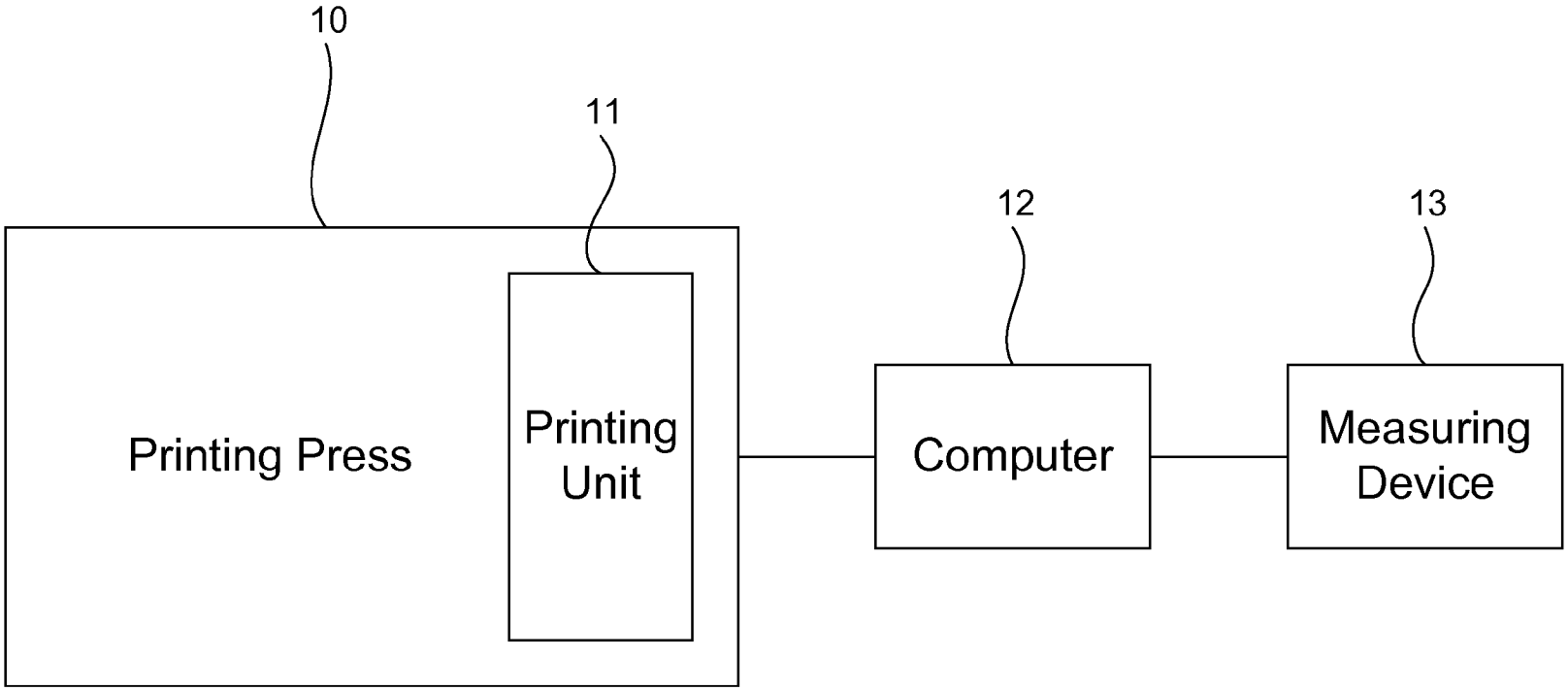
FIG. 4 is diagrammatic view of a printing press with a measuring device.

FIG. 3 plots the color density indicated as "DV" over the setting of the amount of dampening solution, indicated as "Dampening Potentiometer." In this case, the measurement is taken in the full tone. The diagram likewise plots the relationship for high area coverage FD and for low area coverage FD. It can be seen that for high area coverage FD, the color density DV in the full tone hardly changes at all and can thus not be a measure for closed-loop control. In the case of low area coverage FD, however, it can be seen that the color density DV of the full tone increases rapidly and at an early time coming from the right side in the direction of the optimum setting for the amount of dampening solution OK.

If the criterion of the invention is applied and the curve for high area coverage FD for the 84% halftone and the curve for low area coverage FD for the full tone are evaluated, the result is that the optimum amount of dampening solution OK is at 56%. FIGS. 2 and 3 show that this is clearly above the smearing threshold SG. The optimum amount of dampening solution OK is approached in that initially, the control computer 12 of the printing press 10 calculates the optimum amount of dampening solution based on the job data such as printing material, printing ink, characteristic curves of the printing press 10. In addition, the amount of dampening solution is increased above the calculated value to ensure that the computer will always start the metering of the amount of dampening solution on the right side of the optimum amount of dampening solution OK in FIGS. 2 and 3. The amount of dampening solution is then reduced in small steps of 3% and measurements are taken in the corresponding areas on the printing material 1 by a color measuring device 13 until a significant increase occurs in the tonal value curve of the 84% halftone for high area coverage FD in FIG. 2 and a quick or early rise occurs in the color density DV of the full tone in the curve for low area coverage FD in FIG. 3. At this point, the reduction of the dampening solution is stopped as the optimum amount of dampening solution OK is reached in the respective printing unit 11 of the printing press 10.

The invention claimed is:

1. A method for controlling an amount of dampening solution in a printing unit of a printing press, the method comprising the following steps:

providing a computer and a measuring device;

setting the amount of dampening solution in the printing unit based on data of a current print job;

reducing the amount of dampening solution towards a smearing threshold with the computer;

recording color measurement values with the measuring device in at least one full tone area with low area coverage and in at least one halftone area with high area coverage on printed matter of the current print job, the at least one full tone area having low area coverage compared to the at least one halftone area; and stopping the reduction of the amount of dampening solution with the computer when a dot gain of a halftone in areas with high area coverage increases significantly and a density of a full tone in areas with low area coverage increases significantly.

2. The method according to claim 1, which further comprises recording color measurement values with the measuring device in at least two halftone areas on the printed matter.

3. The method according to claim 1, wherein at least one halftone has a tonal value density of between 70 and 90%.

4. The method according to claim 1, which further comprises, for a job change, using the computer to:

calculate a value of the amount of dampening solution required for a following print job; and initially increase the amount of dampening solution above the calculated value at a beginning of the following print job.

5. The method according to claim 1, which further comprises using the computer to:

examine an original image to find suitable color areas for color measuring operations;

identify the suitable color measurement areas in the printed image or color measuring fields in a print control strip; and carry out the measuring operations in the identified areas.

6. The method according to claim 1, which further comprises reducing the amount of dampening solution in steps with the computer, and measuring the areas with the measuring device during the reducing step.

7. The method according to claim 6, wherein the steps are 3% steps.

8. The method according to claim 1, which further comprises comparing different color measurement fields requiring different amounts of dampening solution in a plausibility check, with the computer.

9. The method according to claim 2, which further comprises providing a 25% halftone field.

10. The method according to claim 1, which further comprises recording the color measurement values with the measuring device in the printing press during printing.

* * * * *